US005810354A

United States Patent [19]

Banyai

[11] Patent Number: 5,810,354

[45] Date of Patent: Sep. 22, 1998

[54] METHOD OF PLAYING A POKER GAME

[75] Inventor: Frank B. Banyai, Temecula, Calif.

[73] Assignee: Jester Games International, L.L.C., Las Vegas, Nev.

[21] Appl. No.: 800,072

[22] Filed: Feb. 12, 1997

[51] Int. Cl.[6] ..... A63F 1/00

[52] U.S. Cl. ..... 273/292; 273/274

[58] Field of Search ..... 273/274, 292

[56] References Cited

U.S. PATENT DOCUMENTS

| | | |
|---|---|---|
| 4,659,087 | 4/1987 | Shen et al. . |
| 4,836,553 | 6/1989 | Suttle et al. . |
| 4,861,041 | 8/1989 | Jones et al. . |
| 4,948,134 | 8/1990 | Suttle et al. . |
| 5,022,653 | 6/1991 | Suttle et al. . |
| 5,072,946 | 12/1991 | Miller . |
| 5,098,107 | 3/1992 | Boylan et al. . |
| 5,265,882 | 11/1993 | Malek . |
| 5,275,415 | 1/1994 | Wisted . |
| 5,275,416 | 1/1994 | Schorr et al. . |
| 5,374,067 | 12/1994 | Jones . |
| 5,377,973 | 1/1995 | Jones et al. . |
| 5,377,993 | 1/1995 | Josephs . |
| 5,382,025 | 1/1995 | Sklansky et al. . |
| 5,395,120 | 3/1995 | Malek . |
| 5,415,414 | 5/1995 | Savage . |
| 5,437,462 | 8/1995 | Breeding . |
| 5,486,005 | 1/1996 | Neal . |
| 5,489,101 | 2/1996 | Moody . |
| 5,503,401 | 4/1996 | Nguyen . |
| 5,531,440 | 7/1996 | Dabrowski et al. . |
| 5,531,441 | 7/1996 | Dabrowski . |
| 5,531,448 | 7/1996 | Moody . |
| 5,584,485 | 12/1996 | Jones et al. . |
| 5,584,486 | 12/1996 | Franklin . |

OTHER PUBLICATIONS

Morehead, Albert H., "Official Rules of Card Games", Random House, N.Y., Copyright 1968, pp. 82–125.

Morehead, Albert H., "The Complete Guide to Winning Poker", Simon & Shuster, N.Y., Copyright 1967, pp. 188–214.

Harrison, Dennis R., "Win at the Casino", Lifetime Books, Canada, Copyright 1996, pp. 79–86 (American Poker), pp. 87–99 (Pai Gow Poker), pp. 101–110 (Caribbean Stud), pp. 111–116 (Let It Ride).

Silberstang, Edwin, "Silberstang's Encyclopedia of Games & Gambling", Cardoza Publishing, N.Y., Copyright 1972–1996, pp. 60–66 (Lowball), pp. 67–72 (High–Low Poker), pp. 72–75 (Texas Hold 'Em), pp. 75–82 (Special Features in Poker).

*Primary Examiner*—William M. Pierce
*Attorney, Agent, or Firm*—David Weiss

[57] ABSTRACT

A casino poker game in which each player plays his or her poker hand against the poker hand or hands of a banker who is preferably also the dealer. The game comprises a modified version of draw poker wherein the players may discard cards and improve their hands with a draw, and wherein each player elects among high, low and high-low poker rankings to his or her hand for application against the dealer's high and/or low hands. Progressive jackpot and bad beat bonus payments are available for both high and low player hands.

45 Claims, 5 Drawing Sheets

Fig. 3.

| | HIGH HAND QUALIFIES | | HIGH DECLARED HAND | | LOW DECLARED HAND | HIGH-LOW DECLARED HAND |
|---|---|---|---|---|---|---|
| | YES | NO | POST (FIRST) BET | DECLARATION (SECOND) BET | POST (FIRST) AND DECLARATION (SECOND) BETS | POST (FIRST) AND DECLARATION (SECOND AND THIRD) BETS |
| BANKER | X | | PLAYER LOSES | PLAYER LOSES | PLAYER OR BANKER WINS WITH BETTER HAND | PLAYER LOSES |
| PLAYER | | X | | | | |
| BANKER | | X | NO ACTION | PLAYER WINS | PLAYER OR BANKER WINS WITH BETTER HAND | PLAYER WINS IF BEATS BANKER'S LOW HAND, LOSES OTHERWISE |
| PLAYER | X | | | | | |
| BANKER | X | | PLAYER OR BANKER WINS WITH BETTER HAND | PLAYER OR BANKER WINS WITH BETTER HAND | PLAYER OR BANKER WINS WITH BETTER HAND | PLAYER WINS IF BEATS BANKER'S HIGH AND LOW HANDS, LOSES OTHERWISE |
| PLAYER | X | | | | | |
| BANKER | | X | NO ACTION | PLAYER LOSES | PLAYER OR BANKER WINS WITH BETTER HAND | PLAYER LOSES |
| PLAYER | | X | | | | |

Fig. 4.

| | QUALIFY | | HIGH OR LOW DECLARED HAND | | HIGH-LOW DECLARED HAND |
|---|---|---|---|---|---|
| | YES | NO | POST (FIRST) BET | DECLARATION (SECOND) BET | POST (FIRST) AND DECLARATION (SECOND AND THIRD) BETS |
| BANKER | X | | PLAYER LOSES | PLAYER LOSES | PLAYER LOSES |
| PLAYER | | X | | | |
| BANKER | | X | NO ACTION | PLAYER WINS | PLAYER QUALIFIES BOTH HIGH AND LOW: (1) PLAYER WINS IF NO BANKER HAND QUALIFIES (2) IF ONE BANKER HAND QUALIFIES, PLAYER WINS IF PLAYER BEATS BANKER'S QUALIFYING HAND; LOSES OTHERWISE |
| PLAYER | X | | | | |
| BANKER | X | | PLAYER OR BANKER WINS WITH BETTER HAND | PLAYER OR BANKER WINS WITH BETTER HAND | PLAYER AND BANKER QUALIFY HIGH AND LOW: PLAYER WINS IF BEATS BANKER'S HIGH AND LOW HANDS; LOSES OTHERWISE |
| PLAYER | X | | | | |
| BANKER | | X | NO ACTION | PLAYER LOSES | PLAYER LOSES |
| PLAYER | | X | | | |

METHOD OF PLAYING A POKER GAME

BACKGROUND OF THE INVENTION

This invention relates to the card game of poker, and more particularly to a modified draw poker game for casino play.

The game of poker is conventionally played by a plurality of players who are dealt cards from a deck of fifty-two playing cards. The deck consists of cards of four suits, namely spades, hearts, diamonds and clubs, and each suit contains thirteen cards which, ranking in decreasing order, consist of an Ace, King, Queen, Jack, 10, 9, 8, 7, 6, 5, 4, 3 and 2. A poker hand, consisting of five cards, has a high value or poker rank determined by its containing one of the combinations set forth below in decreasing order of rank based upon the mathematical probability of their occurrence:

Royal Flush—Ace, King, Queen, Jack and 10, all of the same suit;

Straight Flush—five cards in ranking sequence, all of the same suit; Four-of-a-kind—four cards of the same rank;

Full House—three cards of one rank and two cards of another rank;

Flush—five cards of the same suit, not in ranking sequence;

Straight—five cards in ranking sequence, not all of the same suit;

Three-of-a-Kind—three cards of the same rank;

Two Pairs—two cards of one rank and two cards of another rank;

One Pair—two cards of the same rank.

A hand which does not have any of the above combinations is ranked by the highest ranking card it contains, as well as the next highest cards in decreasing order of their rank.

Poker is often played with a deck containing one or two Jokers as a fifty-third and/or fifty-fourth card, designated as wild—e.g., to represent any card its holder does not have, or to represent an Ace or any card needed to complete a Straight or a Flush (also called a "bug").

The two basic forms of poker are draw poker and stud poker. With each form, each player normally places a bet of a predetermined amount (called an "ante") into the "pot" (an accumulation of all bets made by the players in one game) before any cards are dealt. In the game of draw poker as conventionally played, each player is dealt five cards face down. Each player reviews his or her hand and determines whether to "drop" or "fold" (to withdraw from the game) or to participate in a betting interval or round. Each active or remaining player may then, at his or her option, discard any of his or her cards and the dealer then gives such player an equal number of cards to replace the cards discarded. This replacement of discarded cards is called the "draw", and the right of each player to discard cards from his or her closed five card hand as initially dealt and to draw the same number of cards as replacements for the discarded cards is one of the characteristics distinguishing draw poker from stud poker.

A second betting round among the remaining players follows, after which there is a "showdown" in which the players' hands are compared with one another to determine which player wins the pot.

Conventionally, in both draw poker and stud poker, the player holding the highest ranking poker hand of all players at the showdown wins the pot. In one variant, called "lowball", the lowest ranking hand wins the pot; in lowball, the Ace is the lowest card in the deck, and Straights and Flushes are eliminated from consideration. In another variant, known as "high-low", the highest and lowest ranking hands divide the pot equally, or a single hand of both the highest and the lowest ranking combination wins the entire pot. In high-low games where each player declares his intention to go high, low or high-low, such alternative three-way declaration is made at one time, usually at the showdown before the players' hands are revealed.

Poker has been adapted in various forms to casino play. In one type of casino poker, each player plays against each of the other players seated about a table with all bets being contributed to a pot, as in conventional manner. The casino provides the table accommodations along with, in most jurisdictions, a dealer who deals the cards, provides gaming tokens or chips to the players as they desire to purchase them for placing bets, watches the pot to make sure all the players are contributing chips as they should, and compares and announces the winning hands. In return for these services, the casino charges a fee, such as a "rake" (a portion of the pot) or an hourly fee collected from each player. Such poker games include draw poker and stud poker, as well as popular variations of stud poker known as "Texas Hold'Em" (or simply "Hold—Em") and Omaha Poker (including Omaha High-Low Split) in which a "flop" is dealt by the dealer (i.e., cards dealt or flipped face up which are common or community cards for use by each player with his or her own cards to complete his or her five-card poker hand).

In another type of poker adapted to casino play, a banker participates in the game and is dealt a hand, and each player plays against the banker's hand rather than playing against the hands of the other players. Each player places his or her bets on the table at his or her place or station rather than in a pot, and each player's poker hand is compared to the banker's hand with the banker collecting losing bets and paying off winning bets. Although the casino may provide a dealer (as discussed above) and each player in turn may be the banker against whose hand each of the other players bet, in most jurisdictions the banker is usually the dealer who is provided by and represents the casino or "house". Such poker games are commonly played about a table of a type about which the popular game of blackjack is commonly played, referred to as a blackjack-type table.

Popular poker games of this type include "Pai Gow Poker" and "Caribbean Stud" where each player's hand competes with the banker's hand. In each such game, the banker collects bets from each player with a losing hand and pays off bets of each player with a winning hand. These casino poker games, however, do not offer the strategic opportunities of draw poker, nor do these games offer the excitement of employing both high and low poker rankings in establishing winning hands.

SUMMARY OF THE INVENTION

The present invention provides a fast paced casino poker game in which each player plays his or her hand against the hand or hands of a banker, comprising a modified version of draw poker wherein each player may discard cards from and improve his or her hand with a draw and, as a preferred feature of the game, wherein each player elects among high, low and high-low rankings for application to his or her hand.

Briefly described, the present invention provides a method of playing a poker game by at least one player (preferably a plurality of players) and a banker, comprising the steps of (a) each player placing a first bet; (b) dealing five cards from a deck of cards to each player (preferably face down) and to the banker (preferably at least one but not all positioned face up); (c) each player either (1) folding his or her hand, thereby withdrawing from the game and losing his or her first bet, or (2) placing a second bet, thereby remaining in the game; (d) each remaining player, if he or she elects, discarding up to a predetermined number of cards from his or her hand; (e) drawing cards of such predetermined number from the deck and positioning the drawn cards face up; (f) each remaining player selecting from the drawn cards the number of cards discarded by the player during step (d) for completing his or her poker hand; (g) the banker selecting five cards from the cards dealt to the banker and the drawn cards for completing his or her poker hand; and (h) comparing each remaining player's hand to the banker's hand, and the banker settling each remaining player's bets according to predetermined criteria for determining winning and losing poker hands and the amounts won.

A dealer may be provided for dealing and drawing the cards, although the dealing and drawing of the cards are preferably performed by the banker.

According to one aspect of a preferred manner of playing the game, each player who places a second bet during step (c) must declare his or her poker hand as either high or low; during step (g), the banker selects the five cards from the cards dealt to the banker and the drawn cards for completing a high poker hand, and the banker further selects five cards from the cards dealt to the banker and the drawn cards for completing a low poker hand; and during step (h) each player's declared hand is compared to the banker's high or low hand according to the player's declaration. Following step (f), each player, if he or she elects, may place a third bet.

A preferred aspect of the game provides that the third bet placed by a remaining player following step (f) is in consequence of the player's election to change the declaration of his or her poker hand to high-low. Step (h) accordingly includes the steps of determining winning and losing poker hands as between each player holding a high declared hand and the banker's high hand, the banker settling the bets of each player holding a high declared hand; determining winning and losing poker hands as between each player holding a low declared hand and the banker's low hand, the banker settling the bets of each player holding a low declared hand; and determining winning and losing poker hands as between each player holding a high-low declared hand and the banker's hands, the banker settling the bets of each player holding a high-low declared hand.

The casino poker game of the present invention, according to its preferred manner of utilizing the various aspects thereof and its adaptability for being played about a blackjack-type table by at least one player and a dealer, comprises the steps of: (a) providing the dealer with a deck of cards for playing poker; (b) each player placing a first bet before dealing by the dealer of the cards; (c) the dealer dealing five cards from the deck to each player (preferably face down), and dealing five cards from the deck to the dealer, at least one (and preferably two) of the cards dealt to the dealer positioned face up and the others face down; (d) each player either (1) folding his or her hand, thereby withdrawing from the game and losing his or her first bet to the dealer, or (2) declaring his or her poker hand as either high or low and placing a second bet, thereby remaining in the game; (e) each remaining player, if he or she elects, discarding up to a predetermined number of cards from his or her hand; (f) the dealer drawing cards of such predetermined number from the deck and positioning the drawn cards face up; (g) each remaining player selecting from the drawn cards the number of cards discarded by the player during step (e) for completing his or her poker hand; (h) each player, if he or she elects, changing the declaration of his or her poker hand to high-low and placing a third bet; (i) the dealer selecting five cards from the cards dealt to the dealer and the two drawn cards for completing a high poker hand; (j) the dealer selecting five cards from the cards dealt to the dealer and the drawn cards for completing a low poker hand; and (k) the dealer comparing each remaining player's declared hand to the dealer's hands according to the player's declaration and settling each remaining player's bets according to predetermined criteria for determining winning and losing poker hands and the amounts won.

In one example of this preferred manner of playing the game, in step (e) each remaining player may discard either one or two cards of his or her selection; in step (f) the dealer draws two cards from the deck and positions the two drawn cards face up; and in step (g) each remaining player who discarded only one card during step (e) selects one of the two drawn cards for completing his or her poker hand, and each remaining player who discarded two cards during step (e) selects both of the drawn cards for completing his or her poker hand.

Each player's second and third bets may be limited by the amount of such player's first bet. For example, in step (b) the amount of each player's first bet may be selected by the player from a predetermined minimum up to a predetermined maximum; in step (d), the amount of each remaining player's second bet is a predetermined multiple (e.g. twice) of the amount of the player's first bet; and in step (h) the amount of the third bet of each player who changes his or her declaration to high-low is a predetermined multiple of the player's first bet (e.g. twice the amount of the player's first bet or equal to the amount of the player's second bet).

An aspect of the present invention includes a method of implementing a jackpot component in a casino poker game played by at least one player and a banker, comprising the steps of (a) each player placing a bet for participating in the poker game; (b) each player at his or her option buying into a jackpot with a jackpot buy-in payment placed prior to the dealing of cards for the poker game; (c) each player and the banker holding poker hands from cards dealt during the poker game; (d) paying a portion of the jackpot to each player who bought into the jackpot holding a poker hand of a predetermined high ranking combination of cards; and (e) paying a portion of the jackpot to each player who bought into the jackpot holding a poker hand of a predetermined low ranking combination of cards.

Another aspect of the present invention includes a method of implementing a "bad beat" bonus component in a casino poker game played by at least one player and a banker, comprising the steps of (a) each player placing a bet for participating in the poker game; (b) each player holding a poker hand from cards dealt during the poker game and the banker holding high and low poker hands from cards dealt during the poker game; (c) each player declaring his or her hand as high, low or high-low for determining winning and losing poker hands of the respective players as against the banker's poker hands; (d) paying a bonus payment to each player holding a poker hand of a predetermined combination of cards losing to the banker's high hand; and (e) paying a bonus payment to each player holding a poker hand of a predetermined combination of cards losing to the banker's low hand. In step (d) the bonus payment may be paid only if the banker's high hand contains another predetermined combination of cards, and in step (e) the bonus payment may be paid only if the banker's low hand contains another predetermined combination of cards. A bonus payment may also be paid to each player holding a poker hand (either high or low) of a predetermined combination of cards tying one of the banker's hands.

BRIEF DESCRIPTION OF THE DRAWINGS

The novel features which are believed to be characteristic of the invention, together with further advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

FIG. 3 is a chart indicating winning and losing poker hands as between a player and the banker according to one example of the preferred manner of playing the game of the present invention;

FIG. 4 is a chart indicating winning and losing poker hands as between a player and the banker according to another example of the preferred manner of playing the game of the present invention and FIGS. 5 and 5*a* comprise is a flow chart illustrating a preferred manner of playing the casino game of the present invention in its preferred embodiment.

DETAILED DESCRIPTION OF THE PREFERRED EMBODIMENT

Figure 1:
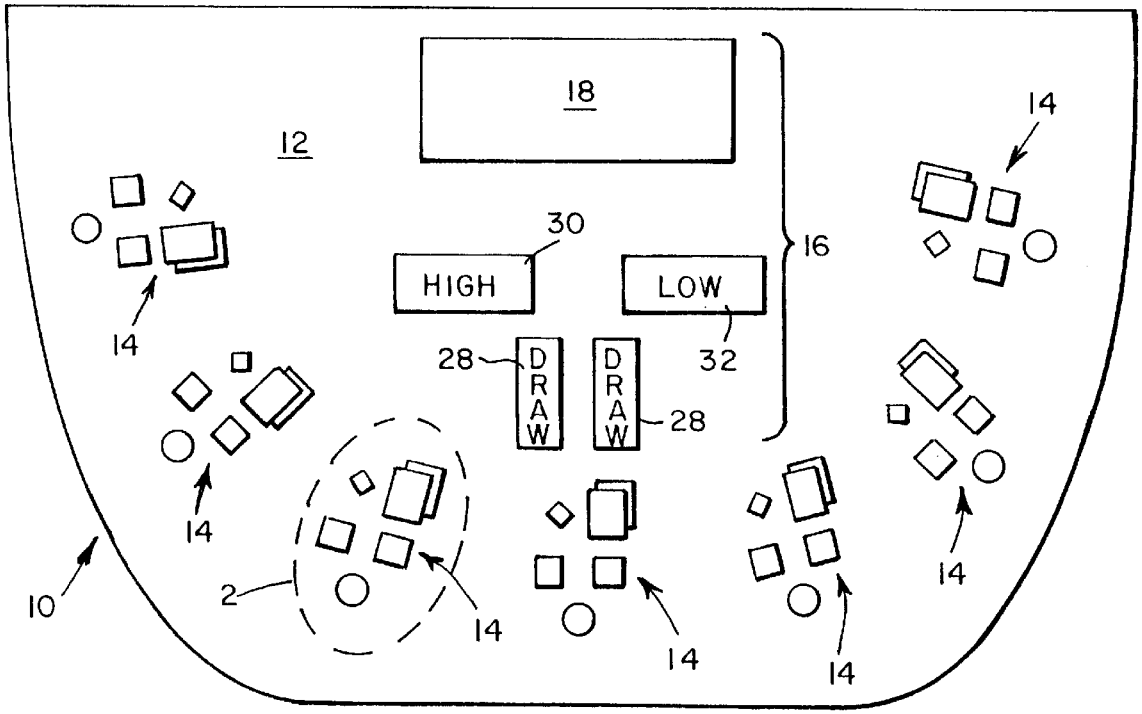
FIG. 1 is a top view of a preferred embodiment of a game table and layout for use in playing the casino poker game of the present invention.
Figure 2:
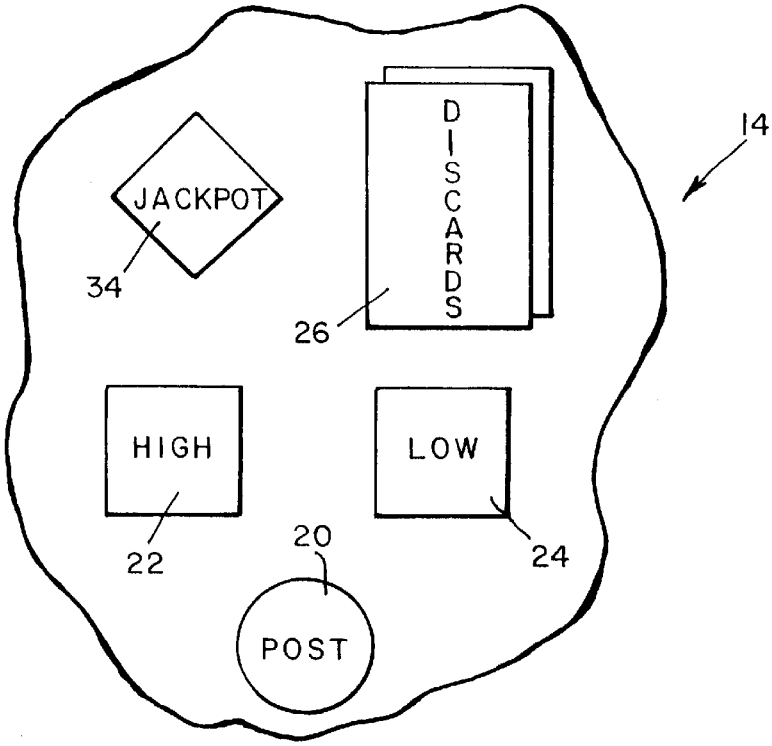
FIG. 2 is a top view of a preferred configuration of a player station of the table layout in FIG. 1 indicated therein by the dashed enclosure 2, shown enlarged for clarity of description.
Figure 5:
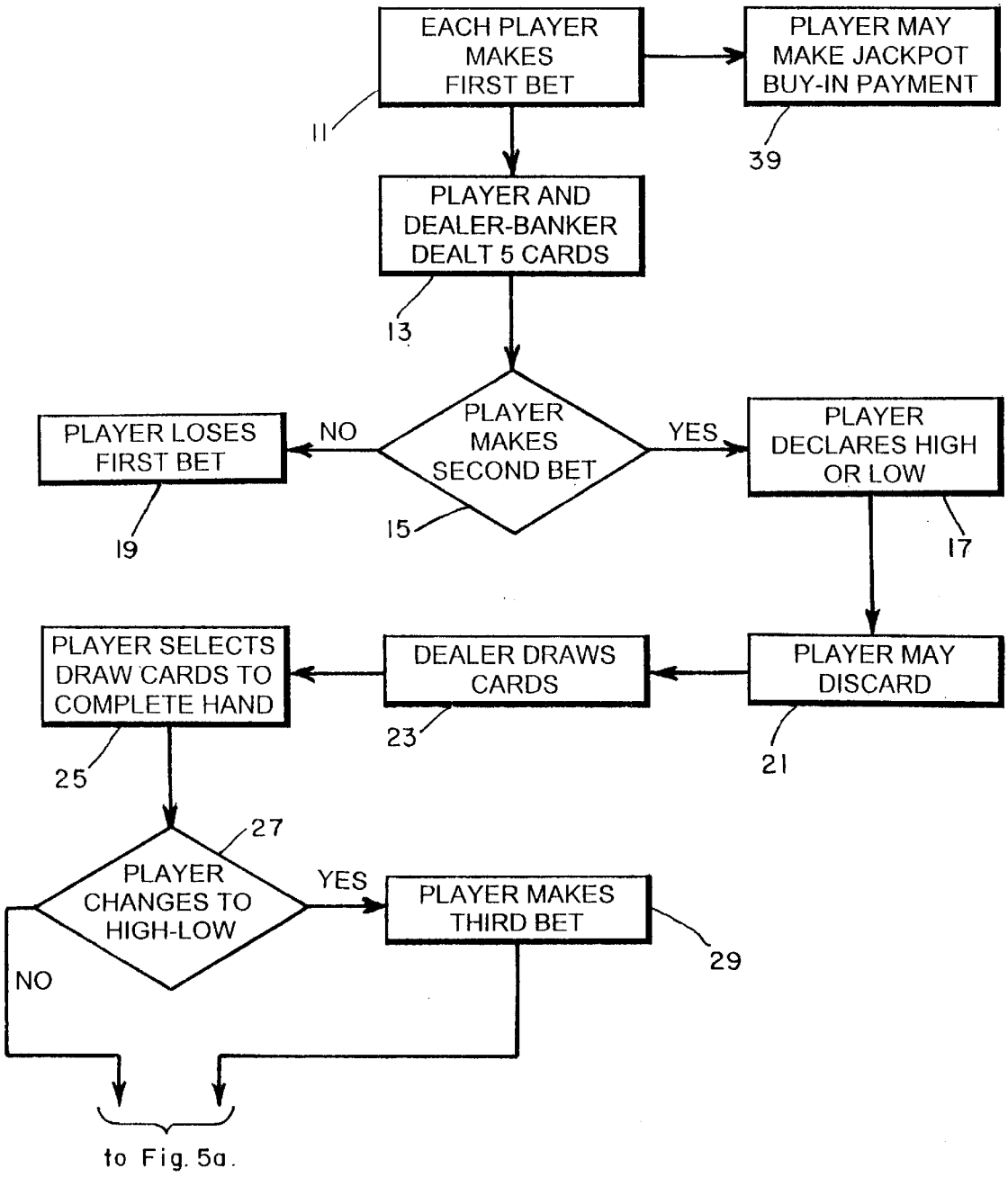
Figure 5A:
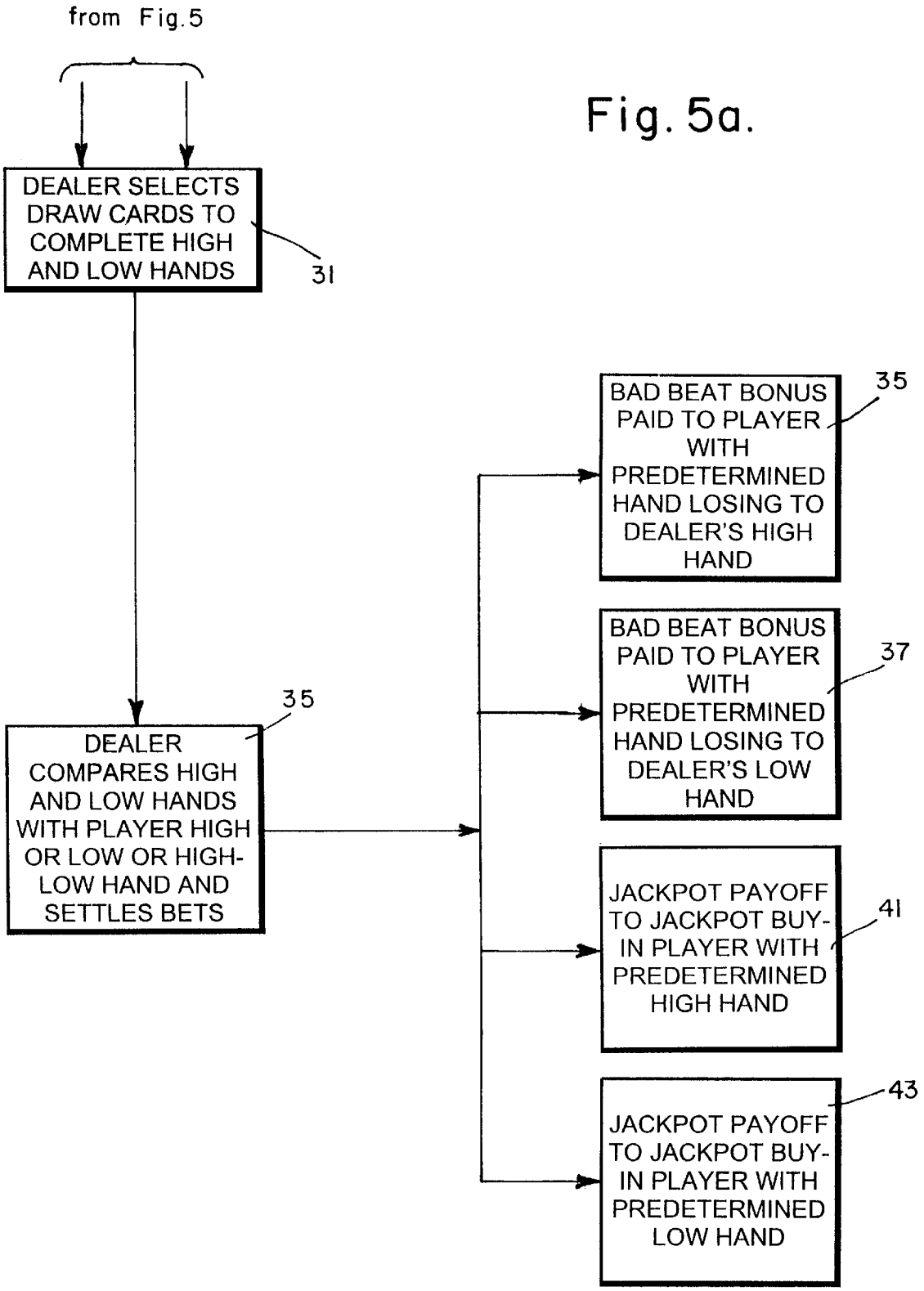

Turning to FIGS. 1, 2 and 5, the preferred embodiment of the casino poker game of the present invention utilizes a blackjack-type table 10 having a table surface layout 12 including a plurality of player stations 14 and a dealer station 16 arranged thereon. Although one of the players may be designated as banker with the responsibility of settling the bets of the other players with his or her own resources, in the preferred game embodiment the dealer is also the banker and settles the bets of the players with the resources of the casino or house. Notwithstanding that the banker, or the banker-dealer, plays against each of the players and is a player or participant in the game, as used herein the term "player" means a person playing the game in competition with the banker or banker-dealer, and the banker and the dealer are excluded from the meaning of the term "player" as used herein merely for purposes of convenience of description.

In accordance with the preferred manner of playing the present game, the players are positioned about the periphery of the table 10 at the player stations 14, while the dealer-banker (or simply "dealer" since, in this preferred embodiment, the banker is the dealer) is positioned along the table periphery at the dealer station 16 generally facing the players. The dealer station 16 includes a tray or rack 18 for containing a store of the casino's gaming tokens or chips which may be purchased by the players and are available for paying off the players' winning bets. The dealer is provided with a conventional deck of fifty-two playing cards (not shown) customarily used for playing poker, to which may be added at least one (and preferably one) Joker as a wild card preferably operating as a bug to represent an Ace or any card needed to complete a Straight or a Flush.

At the beginning of each game and before any cards are dealt by the dealer, each player is required to make or place a first wager or bet (represented at block 11 of FIG. 5) by depositing one or more gaming chips in the marked "POST" area or circle 20 at his or her station 14 of the table layout 12 FIGS. 1 and 2. The first or "POST" bet is similar to a conventional "ante" in that such bet is made before any cards are dealt. However, unlike a conventional ante the amount of which is predetermined by the house, the amount of the POST bet is preferably determined by each player with only the minimum and maximum permissible amounts of the POST bet being predetermined or set by the house.

After the first or POST bets are placed, the dealer deals five cards to each player and to the dealer block 13. The five cards to each player are preferably dealt face down so that each player is dealt a closed hand, and the five cards dealt to the dealer are positioned such that two cards are face up and three cards are face down. For example, the dealer may deal himself five face down cards, and then turn two of these cards face up, placing one of the face up cards on top of the three face down cards and moving the two face up cards side-by-side so that both face up cards may be viewed by each player.

Each player may then view his or her own five card hand against the dealer's two face up cards, and each player must decide either to fold or to remain in the game by placing a second bet (block 15). A player who decides to remain in the game in this preferred embodiment thereof also must declare his hand as either high or low, (block 17). Such decisions are indicated to the dealer by the player placing the second or "declaration" bet, accomplished by the player placing one or more gaming chips of appropriate value in either the marked "HIGH" area or square 22 or the marked "LOW" area or square 24 at the player's station 14 on the layout 12, declaring his or her poker hand as respectively either high or low. A player who declines to place a second bet in accordance with a declaration as either high or low indicates to the dealer that such player is folding his or her hand and withdrawing from the game, and such player loses his or her first or POST bet to the dealer (block 19).

Although the game may be played with the dealer positioning fewer (i.e. one) or more (but not all) than two of the cards dealt to him face up, the provision that two cards be positioned face up is preferred as giving meaningful information to the players for permitting them to decide between high and low declarations when making their second bets, and whether to change their declaration to high-low and make a third bet as later discussed herein, while at the same time providing reasonable odds as between the players and the house.

Each remaining player (i.e., each player who places a "declaration" or second bet, thereby remaining in the game) may, if he or she elects, discard up to a predetermined number of cards from his or her hand (block 21). In the preferred game embodiment, this predetermined number is two, so that each remaining player may discard either one or two cards of the player's selection from the five cards dealt to him or her, the player placing the selected one or two cards (preferably face down) in the marked "DISCARDS" area or rectangle 26 at the player's station 14 on the layout 12. A player may elect against discarding any cards from his hand, i.e. he may elect to "stand pat", retaining the five cards originally dealt to him without seeking to improve his hand by discarding cards and participating in the draw although entitled to do so.

The dealer then deals or draws cards of the predetermined number from the deck and positions the drawn or draw cards face up at the dealer station 16 on the table 10 (block 21). In the preferred game embodiment, such predetermined number of cards is two as previously noted, so that the dealer draws two cards from the deck and places them face up on the two marked "DRAW" areas or rectangles 28 on the layout 12. Prior to drawing the two cards, the dealer may "burn" a card, i.e. by removing the top card from the deck and discarding it or placing it at the bottom of the deck.

Each player who had previously discarded a card or cards from his original hand selects from the face up drawn cards the same number of cards which he or she had discarded (block 25), as replacements for the discarded card or cards. In the preferred game embodiment wherein the predetermined number of drawn cards is two, each remaining player who had previously discarded only one card selects one of the two drawn cards for completing his or her poker hand, and each remaining player who had previously discarded two cards selects both of the drawn cards for completing his or her poker hand. Of course, such "selection " by each player is a mental step only, in that the players do not actually pick up the "selected" card or cards since these drawn cards are available to each player electing a draw, but each player notes the card or cards which are desired for completing his or her poker hand in accordance with the player's previous declaration as either high or low and as each player may be influenced by such player's option to change his or her declaration as described immediately below.

Following the dealer's drawing of the cards and placing the drawn cards face up on the table 10, each remaining player, if he or she elects, may change the declaration of his or her poker hand to high-low (block 27), i.e. a player may elect to go "both ways" for winning both the high and the low value hands with such player's five card hand (either as originally dealt if the player had stood pat or as improved by the draw if the player had previously discarded one or two cards from his or her hand). Each player electing to change the declaration of his or her poker hand to high-low indicates to the dealer the player's intention to do so by placing another declaration bet, i.e. a third bet (block 29), implemented by placing gaming chips of appropriate value in the previously unoccupied one of the marked HIGH and LOW areas 22, 24 thereby covering both of the HIGH and LOW declaration bet areas 22, 24.

As previously noted, the amount of each player's POST or first bet is preferably selected by the player from a predetermined minimum up to a predetermined maximum, set by the house. The amounts of each remaining player's declaration bets are preferably predetermined multiples (also set by the house) of the amount of such player's POST bet. For example, the amount of each remaining player's second bet may be predetermined as twice the amount of such player's first or POST bet, and the amount of such player's third bet may be predetermined as equal to the amount of such player's second bet.

After all players electing to change their declarations to high-low have done so, the dealer turns face up the three face down cards in the dealer's hand and makes the best high and low five card poker hands possible from the dealer's originally dealt five cards and the two drawn cards (block 31). The dealer turns each remaining player's cards face up, compares each remaining player's declared hand to the dealer's hands according to the player's declaration and settles each remaining player's bets according to predetermined criteria for determining winning and losing poker hands and the amounts won (block 33).

In implementing the making or completion of the dealer's high and low hands, the comparing of hands and the settlement of bets (blocks 31 and 33) in an organized manner, the dealer first selects five cards from the five cards originally dealt to the dealer and the two drawn cards for completing the dealer's best high poker hand, arranging the originally dealt cards included in such high hand in the marked "HIGH" area or rectangle 30 at the dealer station 16 on the table layout 12, and indicating which one or two (if any) of the drawn cards in the marked "DRAW" area 28 are included in the dealer's high hand. The dealer thereupon compares the hand of each player holding a high declared hand to the dealer's high hand, determines winning and losing hands as between the hands compared, and settles the bets of each player according to whether such player holds a winning or losing high declared hand as compared to the dealer's high hand.

The dealer then selects five cards from the five cards originally dealt to the dealer and the two drawn cards for completing the dealer's best low poker hand, arranging the originally dealt cards included in such low hand in the marked "LOW" area or rectangle 32 at the dealer station 16 on the table layout 12, and indicates which one or two (if any) of the drawn cards in the marked "DRAW " areas 28 are included in the dealer's low hand. The dealer thereupon compares the hand of each player holding a low declared hand to the dealer's low hand, determines winning and losing hands as between the hands compared, and settles the bets of each such player according to whether such player holds a winning or losing low declared hand.

The dealer further compares the hand of each player holding a high-low declared hand to the dealer's high and low hands as arranged above, determines winning and losing hands as between the hands compared, and settles the bets of each such player according to whether he or she holds a winning or losing high-low declared hand.

It may be appreciated that, until all player bets are settled, the dealer does not remove the drawn cards from their marked "DRAW" areas 28 since these drawn cards must be referred to for the players' hands and for both of the dealer's hands.

The predetermined criteria for determining winning and losing poker hands are based upon conventional poker rank, i.e. the value of the respective poker hands as previously discussed. For example, in settling the bets of each player, the dealer may collect the bets of each player holding a high declared hand of lower poker rank than the dealer's high hand, and pay to each player holding a high declared hand of higher poker rank than the dealer's high hand an amount determined by the player's bets. The dealer may collect the bets of each player holding a low declared hand of higher poker hand than the dealer's low hand and pay to each player holding a low declared hand of lower poker rank than the dealer's low hand an amount determined by the player's bets. With respect to either high declared or low declared hands, a tie or "push" wherein both a player and the dealer have hands of equal rank or value, results in a standoff and the player does not lose his or her POST bet or declaration bet, i.e. there will be "no action" on the bets. With respect to a high-low declared hand, however, the dealer may win all ties, so that the dealer collects the POST and declaration bets of each player holding a high-low declared hand which is not of both higher poker rank than the dealer's high hand and lower poker rank than the dealer's low hand, and pays to each player holding a high-low declared hand of both higher poker rank than the dealer's high hand and lower poker rank than the dealer's low hand an amount determined by the player's bets.

The settlement of bets may also include a requirement that a hand considered high (i.e., a player's high declared hand, or the dealer's high hand, or a player's high-low declared hand when compared to the dealer's high hand) be "qualified"—as by being of at least a predetermined rank —as a part of the predetermined criteria for determining winning and losing poker hands. For example, the minimum predetermined rank required for a high hand to qualify may be of, say, a pair of 8's, in which case a high poker hand will qualify only if that hand contains a pair of 8's or better, i.e. a combination of cards having a poker rank of that of at least a pair of 8's.

Using a "qualifying" requirement for high hands, but not for low hands, criteria for determining winning and losing hands are tabulated in the chart of FIG. 3. As indicated therein, with respect to a player holding a high declared hand, if the player's hand does not qualify (i.e. is not of at least the predetermined qualifying poker rank), the dealer collects the player's second bet and, if the dealer's high hand qualifies, the dealer further collects the player's first or POST bet (if the dealer's high hand does not qualify there is no action on the player's POST bet). If the player's high declared hand qualifies and the dealer's high hand does not qualify, the dealer pays to the player an amount determined by the player's second bet and there is no action on the player's POST bet. If the player's high declared hand and the dealer's high hand both qualify, the dealer collects the player's first and second bets if the player's hand is of lower poker rank than the dealer's high hand, and the dealer pays to the player an amount determined by the player's POST and second bets if the player's hand is of higher poker rank than the dealer's high hand; there is no action as to both bets for ties.

With respect to a player holding a low declared hand in this example, the dealer collects the player's first and second bets if the player's hand is of higher poker rank than the dealer's low hand, and the dealer pays to the player an amount determined by the player's POST and second bets if the player's hand is of lower poker rank than the dealer's low hand; there is no action as to both bets for ties.

With respect to a player holding a high-low declared hand in this example, if the player's hand does not qualify the dealer collects the player's first, second and third bets (i.e. the POST bet and both declaration bets). If the player's hand qualifies and the dealer's high hand does not qualify, the dealer collects the player's first, second and third bets if the player's hand is not of lower poker rank than the dealer's low hand, and the dealer pays to the player an amount determined by the player's first, second and third bets if the player's hand is of lower poker rank than the dealer's low hand. If the player's hand and the dealer's high hand both qualify, the dealer collects the player's first, second and third bets if the player's hand is not of both higher poker rank than the dealer's high hand and lower poker rank than the dealer's low hand, and the dealer pays to the player an amount determined by the player's first, second and third bets if the player's hand is of both higher poker rank than the dealer's high hand and lower poker rank than the dealer's low hand. The player loses all ties respecting a high-low declared hand.

The settlement of bets may also (or alternatively) include a requirement that a hand considered low (i.e., a player's low declared hand, or the dealer's low hand, or a player's high-low declared hand when compared to the dealer's low hand) be qualified—as by being of or lower than a predetermined rank—as a part of the predetermined criteria for determining winning and losing poker hands. A low hand may qualify only if its value is lower than, e.g., a pair and the highest ranking card contained in the hand is say, an 8 or lower.

In a second example where a qualifying requirement is used for low hands but not for high hands, with respect to a player holding a high declared hand, the dealer collects the player's first and second bets if the player's hand is of lower poker rank than the dealer's high hand, and the dealer pays to the player an amount determined by the player's first and second bets if the player's hand is of higher poker rank than the dealer's high hand; there is no action as to both bets for ties.

With respect to a player holding a low declared hand in this second example, if the player's hand does not qualify (i.e. is not of or lower than the predetermined qualifying poker rank), the dealer collects the player's second bet and, if the dealer's low hand qualifies, the dealer further collects the player's first or POST bet (if the dealer's low hand does not qualify there is no action on the player's POST bet). If the player's low declared hand qualifies and the dealer's low hand does not qualify, the dealer pays to the player an amount determined by the player's second bet and there is no action on the player's POST bet. If the player's low declared hand and the dealer's low hand both qualify, the dealer collects the player's POST and second bets if the player's hand is of higher poker rank than the dealer's low hand, and the dealer pays to the player an amount determined by the player's POST and second bets if the player's hand is of lower poker rank than the dealer's low hand; there is no action as to both bets for ties.

With respect to a player holding a high-low declared hand in this second example, if the player's hand does not qualify the dealer collects the player's first, second and third bets (i.e. the POST bet and both declaration bets). If the player's hand qualifies and the dealer's low hand does not qualify, the dealer collects the player's first, second and third bets if the player's hand is not of higher poker rank than the dealer's high hand, and the dealer pays to the player an amount determined by the player's first, second and third bets if the player's hand is of higher poker rank than the dealer's high hand. If the player's hand and the dealer's low hand both qualify, the dealer collects the player's first, second and third bets if the player's hand is not of both higher poker rank than the dealer's high hand and lower poker rank than the dealer's low hand, and the dealer pays to the player an amount determined by the player's first, second and third bets if the player's hand is of both higher poker rank than the dealer's high hand and lower poker rank than the dealer's low hand. The player loses all ties respecting a high-low declared hand.

FIG.4 tabulates the case of a third example wherein a qualifying requirement is used for both high and low, i.e. a hand considered high "qualifies" if it is of at least a first predetermined rank (such as a pair of 8's) and a hand considered low "qualifies" if it is of or lower than a second predetermined rank (such as an 8 high). As indicated therein, with respect to a player holding a high declared hand, if the player's hand does not qualify the dealer collects the player's second bet and, if the dealer's high hand qualifies, the dealer further collects the player's first or POST bet (if the dealer's high hand does not qualify there is no action on the player's POST bet). If the player's high declared hand qualifies and the dealer's high hand does not qualify, the dealer pays to the player an amount determined by the player's second bet and there is no action on the player's POST bet. If the player's high declared hand and the dealer's high hand each qualify, the dealer collects the player's POST and second bets if the player's hand is of lower poker rank than the dealer's high hand, and the dealer pays to the player an amount determined by the player's POST and second bets if the player's hand is of higher poker rank than the dealer's high hand; there is no action as to both bets for ties.

With respect to a player holding a low declared hand in this third example, if the player's hand does not qualify the dealer collects the player's second bet and, if the dealer's low hand qualifies, the dealer further collects the player's POST bet (if the dealer's low hand does not qualify there is no action on the player's POST bet). If the player's low declared hand qualifies and the dealer's low hand does not qualify, the dealer pays to the player an amount determined by the player's second bet and there is no action on the player's POST bet. If the player's low declared hand and the dealer's low hand each qualify, the dealer collects the player's POST and second bets if the player's hand is of higher poker rank than the dealer's low hand, and the dealer pays to the player an amount determined by the player's first and second bets if the player's hand is of lower poker rank than the dealer's low hand; there is no action as to both bets for ties.

With respect to a player holding a high-low declared hand in this third example, if the player's hand does not qualify either high or low, the dealer collects the player's first, second and third bets (i.e. the POST bet and both declaration bets). If the player's hand qualifies both high and low and neither of the dealer's hands qualify, the dealer pays to the player an amount determined by the player's first, second and third bets. If the player's hand qualifies both high and low and the dealer's high hand qualifies but the dealer's low hand does not qualify, the dealer collects the player's first, second and third bets if the player's hand (when considered high) is not of higher poker rank than the dealer's high hand, and the dealer pays to the player an amount determined by the player's first, second and third bets if the player's hand (when considered high) is of higher poker rank than the dealer's high hand. If the player's hand qualifies both high and low and the dealer's low hand qualifies but the dealer's high hand does not qualify, the dealer collects the player's first, second and third bets if the player's hand (when considered low) is not of lower poker rank than the dealer's low hand, and the dealer pays to the player an amount determined by the player's first, second and third bets if the player's hand (when considered low) is of lower poker rank than the dealer's low hand. If the player's hand qualifies both high and low and the dealer's high and low hands both qualify, the dealer collects the player's first, second and third bets if the player's hand is not of both higher poker rank (when considered high) than the dealer's high hand and (when considered low) of lower poker rank than the dealer's low hand, and the dealer pays to the player an amount determined by the player's first, second and third bets if the player's hand is of both higher poker rank (when considered high) than the dealer's high hand and is of lower poker rank (when considered low) than the dealer's low hand. The player loses all ties respecting a high-low declared hand.

Winning payoffs for high declared and low declared hands may reflect even odds for both the POST and the declaration (second) bets, whereas the payoff for a winning high-low declared hand may be a multiple (e.g. double) the declaration (first and second) bets and even money on the POST bet.

In addition, a player may be paid bonuses if he or she holds a losing hand of a predetermined combination of cards, known as a "bad beat". For example, a player whose high declared or low declared hand is beat by the dealer will lose his or her POST and declaration bets, but in accordance with the game's bad beat bonus component the player losing to the dealer's high hand (block 35 of FIG. 5) and the player losing to the dealer's low hand (block 37) will nevertheless be paid a bonus (e.g. a predetermined multiple of such player's declaration bet) if his or her losing hand is of a predetermined combination of cards. A further condition may be imposed for paying a bad beat bonus, such as the player's holding a hand containing a predetermined combination of cards losing to the dealer with a hand containing another predetermined combination of cards. Examples of bad beat hands and bonus payments for high declared hands may be: a Full House of Aces over 10's (three Aces and a pair of 10's) or higher beat by a higher ranking hand will pay ten times the declaration bet; Four-of-a-Kind beat by a higher ranking Four-of-a-Kind will pay twenty times the declaration bet; and a Straight Flush beat by a higher ranking Straight Flush will pay fifty times the declaration bet. Examples of bad beat hands and bonuses for low declared hands may be: a "6-5 high" hand (usually referred to simply as a 6-5) beat by a 6-4 will pay five times the declaration bet; and a 6-4 beat by a "wheel" (5-4-3-2-Ace) will pay ten times the declaration bet. A bonus may also be paid to a player holding a poker hand (either high or low) of a predetermined combination of cards tied by one of the dealer's hands; e.g. a player's hand containing a Royal Flush tied by another Royal Flush held by the dealer will pay one thousand times the declaration bet.

Bad beat bonuses for high-low declared hands may be paid according to both forgoing bonus schedules as applicable. For example, a player holding a Straight Flush wheel will lose to the dealer's high hand comprising a higher ranking Straight Flush. Although the player would lose the POST and declaration bets since the player's hand does not beat both the high and low hands of the dealer, the player would nevertheless be paid a bad beat bonus equal to fifty times the player's declaration (second and third) bets since the player held a Straight Flush that was beat by the dealer's higher ranking Straight Flush. In another example, a player holding a high-low declared hand containing a Flush with card rankings Ace-2-3-4-6 will lose the low hand to the dealer's Ace-2-3-4-5 Straight, the player thereby losing the POST bet and both declaration bets to the dealer. However, since the player's low hand 6-4 is beat by the dealer's wheel, the player is paid the low hand (or low end) bad beat bonus of ten times the player's declaration bets.

The game may also include a progressive jackpot component, which each player at his or her option may buy into by placing a jackpot buy-in payment (block 39 of FIG. 5) at the time the player places his or her POST bet. The player may participate in the jackpot by placing a gaming chip of a predetermined value in the marked "JACKPOT" area or diamond 34 at the player's station 14 on the table layout 12 (FIGS. 1 and 2). A player participating in the jackpot component holding a poker hand of a predetermined high ranking combination of cards is a winner of a portion of the jackpot (block 41), and a participating jackpot player holding a poker hand of a predetermined low ranking combination of cards is a winner of a portion of the jackpot block 43. The jackpot may be seeded by the game operator or house and increased with the players' jackpot buy-in payments. The allocated amount of the jackpot may be apportioned between two jackpot payments for each of the high and low jackpot categories, for example a primary jackpot paying say 75% of the total allocated jackpot amount and a secondary jackpot paying say 25% of the allocated jackpot amount. An example of jackpot payments for a high hand may be that the primary jackpot is won by a player holding a Royal Flush and the secondary jackpot is won by a player holding a Straight Flush. An example of jackpot winners for a low hand may include a suited wheel for the primary jackpot and a suited 6-4 for the secondary jackpot.

If the poker game is played with a deck of cards which includes a Joker, it is preferred that a poker hand containing a Joker be excluded from the bad beat bonus and/or jackpot payoffs.

Thus there has been described a preferred embodiment of a casino poker game in which each player plays his or her hand against the hand or hands of a banker who is preferably also the dealer. The game comprises a modified version of draw poker wherein the players may discard cards and improve their hands with a draw, and wherein each player elects among high, low and high-low rankings to his or her hand for application against the dealer's high and/or low hands. Other embodiments of the game and the table layout of the present invention, as well as variations in the manner of playing the game including electronic or computerized versions thereof, may be developed without departing from the essential characteristics thereof. Accordingly, the invention should be limited only by the scope of the claims listed below.

I claim:

1. A method of playing a poker game by at least one player and a banker, comprising the steps of:

(a) each player placing a first bet;

(b) dealing five cards from a deck of cards to each player and to the banker;

(c) each player either (1) folding his or her hand, thereby withdrawing from the game and losing his or her first bet, or (2) placing a second bet, thereby remaining in the game;

(d) each remaining player, if he or she elects, discarding up to a predetermined number of cards from his or her hand;

(e) drawing cards of said predetermined number from the deck and positioning the drawn cards face up;

(f) each remaining player mentally selecting from the drawn cards the number of cards discarded by the player during step (d) for completing his or her poker hand;

(g) the banker selecting five cards from the cards dealt to the banker and the drawn cards for completing his or her poker hand; and (h) comparing each remaining player's hand to the banker's hand, and the banker settling each remaining player's bets according to predetermined criteria for determining winning and losing poker hands and the amounts won.

2. The method according to claim 1, wherein:

in step (b), at least one but not all of the cards dealt to the banker are positioned face up.

3. The method according to claim 1, wherein:

in step (b), the cards dealt to each player are dealt face down.

4. The method according to claim 1, wherein:

a dealer is provided for dealing and drawing the cards.

5. The method according to claim 1, wherein:

the dealing and drawing of the cards are performed by the banker.

6. The method according to claim 1, wherein:

the amount of each player's first bet is selected by the player up to a predetermined maximum, and the amount of each player's second bet is a predetermined multiple of the amount of the player's first bet.

7. The method according to claim 1, wherein:

during steps (d) and (e), said predetermined number of cards is two.

8. The method according to claim 1, further including the step of:

the banker paying a bonus payment to each remaining player holding a losing hand of a predetermined combination of cards.

9. The method according to claim 1, wherein:

during step (a), each player at his or her option may buy into a jackpot with a jackpot buy-in payment; and each player who bought into said jackpot holding a hand of a predetermined combination of cards is a winner of at least a portion of said jackpot.

10. The method according to claim 1, wherein:

during step (c), each player who places a second bet declaring his or her poker hand as either high or low;

during step (g), the banker selecting the five cards from the cards dealt to the banker and the drawn cards for completing a high poker hand, and further selecting five cards from the cards dealt to the banker and the drawn cards for completing a low poker hand; and during step (h), each player's declared hand is compared to the banker's high or low hand according to the player's declaration.

11. The method according to claim 10, wherein:

during step (a), each player at his or her option may buy into a jackpot with a jackpot buy-in payment; and each player who bought into said jackpot holding a poker hand of a predetermined high ranking combination of cards is a winner of a portion of said jackpot;

and each player who bought into said jackpot holding a poker hand of a predetermined low ranking combination of cards is a winner of a portion of said jackpot.

12. The method according to claim 10, wherein:

following step (f), each remaining player, if he or she elects, placing a third bet.

13. The method according to claim 10, wherein step (h) includes the steps of:

determining winning and losing poker hands as between the hand of each player holding a high declared hand and the banker's high hand, the banker settling the bets of each player holding a high declared hand; and determining winning and losing poker hands as between the hand of each player holding a low declared hand and the banker's low hand, the banker settling the bets of each player holding a low declared hand.

14. The method according to claim 13, further including the steps of:

paying a bonus payment to each remaining player holding a poker hand of a predetermined high ranking combination of cards losing to the banker's high hand; and paying a bonus payment to each remaining player holding a poker hand of a predetermined low ranking combination of cards losing to the banker's low hand.

15. The method according to claim 13, further including the steps of:

paying a bonus payment to each remaining player holding a poker hand of a predetermined high ranking combination of cards losing to the banker's high hand containing another predetermined high ranking combination of cards; and paying a bonus payment to each remaining player holding a poker hand of a predetermined low ranking combination of cards losing to the banker's low hand containing another predetermined low ranking combination of cards.

16. The method according to claim 10, wherein:

in step (b), at least one but not all of the cards dealt to the banker are positioned face up.

17. The method according to claim 10, wherein:

in step (b), two of the cards dealt to the banker are positioned face up and three of the cards dealt to the banker are positioned face down.

18. The method according to claim 10, wherein:

in step (b), the cards dealt to each player are dealt face down.

19. The method according to claim 10, wherein step (h) includes the steps of:

the banker collecting the bets of each player holding a high declared hand of lower poker rank than the banker's high hand, and paying to each player holding a high declared hand of higher poker rank than the banker's high hand an amount determined by the player's bets; and the banker collecting the bets of each player holding a low declared hand of higher poker rank than the banker's low hand, and paying to each player holding a low declared hand of lower poker rank than the banker's low hand an amount determined by the player's bets.

20. The method according to claim 10, wherein step (h) includes the steps of:

with respect to each player holding a high declared hand (x) if the player's hand is not of at least a predetermined poker rank, the banker collects the player's second bet and, if the banker's high hand is of at least said predetermined rank, the banker further collects the player's first bet, (y) if the player's hand is of at least said predetermined rank and the banker's high hand is not of at least said predetermined rank, the banker pays to the player an amount determined by the player's second bet, and (z) if the player's hand and the banker's high hand are each of at least said predetermined rank, the banker collects the player's first and second bets if the player's hand is of lower poker rank than the banker's high hand, and pays to the player an amount determined by the player's first and second bets if the player's hand is of higher poker rank than the banker's high hand.

21. The method according to claim 1, wherein:

during step (c), each player who places a second bet declaring his or her poker hand as either high or low;

following step (f), each remaining player, if he or she elects, changing the declaration of his or her poker hand to high-low and placing a third bet;

during step (g), the banker selecting the five cards from the cards dealt to the banker and the drawn cards for completing a high poker hand, and further selecting five cards from the cards dealt to the banker and the drawn cards for completing a low poker hand; and during step (h), each player's declared hand is compared to the banker's hands according to the player's declaration.

22. The method according to claim 21, wherein:

during step (a), the amount of each player's first bet is selected by the player from a predetermined minimum up to a predetermined maximum;

during step (c), the amount of each remaining player's second bet is a predetermined multiple of the amount of the player's first bet; and following step (f), the amount of the third bet of each player who changes his or her declaration to high-low is a predetermined multiple of the amount of the player's first bet.

23. The method according to claim 21, wherein:

in step (b), at least one but not all of the cards dealt to the banker are positioned face up.

24. The method according to claim 21, wherein:

in step (b), two of the cards dealt to the banker are positioned face up and three of the cards dealt to the banker are positioned face down.

25. The method according to claim 21, wherein:

in step (b), the cards dealt to each player are dealt face down.

26. The method according to claim 21, wherein step (h) includes the steps of:

determining winning and losing poker hands as between each player holding a high declared hand and the banker's high hand, the banker settling the bets of each player holding a high declared hand;

determining winning and losing poker hands as between each player holding a low declared hand and the banker's low hand, the banker settling the bets of each player holding a low declared hand; and determining winning and losing poker hands as between each player holding a high-low declared hand and the banker's hands, the banker settling the bets of each player holding a high-low declared hand.

27. The method according to claim 21, wherein step (h) includes the steps of:

the banker collecting the bets of each player holding a high declared hand of lower poker rank than the banker's high hand, and paying to each player holding a high declared hand of higher poker rank than the banker's high hand an amount determined by the player's bets;

the banker collecting the bets of each player holding a low declared hand of higher poker rank than the banker's low hand, and paying to each player holding a low declared hand of lower poker rank than the banker's low hand an amount determined by the player's bets; and the banker collecting the bets of each player holding a high-low declared hand which is not of both higher poker rank than the banker's high hand and lower poker rank than the banker's low hand, and paying to each player holding a high-low declared hand of both higher poker rank than the banker's high hand and lower poker rank than the banker's low hand an amount determined by the player's bets.

28. The method according to claim 21, wherein step (h) includes the steps of:

with respect to a player holding a high declared hand (x) if the player's hand is not of at least a predetermined poker rank, the banker collects the player's second bet and, if the banker's high hand is of at least said predetermined rank, the banker further collects the player's first bet, (y) if the player's hand is of at least said predetermined poker rank and the banker's high hand is not of said predetermined rank, the banker pays to the player an amount determined by the player's second bet, and (z) if the player's hand and the dealer's high hand are each of at least said predetermined rank, the banker collects the player's first and second bets if the player's hand is of lower poker rank than the banker's high hand, and the banker pays to the player an amount determined by the player's first and second bets if the player's hand is of higher poker rank than the dealer's high hand.

29. The method according to claim 21, wherein a hand considered high qualifies if it is of at least a first predetermined rank and a hand considered low qualifies if it is of or lower than a second predetermined rank, and wherein step (h) includes the steps of:

with respect to a player holding a high declared hand (x) if the player's hand does not qualify, the banker collects the player's second bet and, if the banker's high hand qualifies, the banker further collects the player's first bet, (y) if the player's hand qualifies and the banker's high hand does not qualify, the banker pays to the player an amount determined by the player's second bet, and (z) if the player's hand and the banker's high hand each qualify, the banker collects the player's first and second bets if the player's hand is of lower poker rank than the banker's high hand, and the banker pays to the player an amount determined by the player's first and second bets if the player's hand is of higher poker rank than the banker's high hand;

with respect to a player holding a low declared hand (x) if the player's hand does not qualify, the banker collects the player's second bet and, if the banker's low hand qualifies, the banker further collects the player's first bet, (y) if the player's hand qualifies and the banker's low hand does not qualify, the banker pays to the player an amount determined by the player's second bet, and (z) if the player's hand and the banker's low hand each qualify, the banker collects the player's first and second bets if the player's hand is of higher poker rank than the banker's low hand, and the banker pays to the player an amount determined by the player's first and second bets if the player's hand is of lower poker rank than the banker's low hand; and with respect to a player holding a high-low declared hand (x) if the player's hand does not qualify either high or low, the banker collects the player's first, second and third bets, (y) if the player's hand qualifies both high and low and neither of the banker's hands qualify, the banker pays to the player an amount determined by the player's first, second and third bets, (z) if the player's hand qualifies both high and low and the banker's high hand qualifies and the banker's low hand does not qualify, the banker collects the player's first, second and third bets if the player's hand is not of higher poker rank than the banker's high hand, and the banker pays to the player an amount determined by the player's first, second and third bets if the player's hand is of higher poker rank than the banker's high hand, and (xx) if the player's hand qualifies both high and low and the banker's low hand qualifies and the banker's high hand does not qualify, the banker collects the player's first, second and third bets if the player's hand is not of lower poker rank than the banker's low hand, and the banker pays to the player an amount determined by the player's first, second and third bets if the player's hand is of lower poker rank than the banker's low hand, and (xy) if the player's hand qualifies both high and low and the banker's high and low hands both qualify, the banker collects the player's first, second and third bets if the player's hand is not of both higher poker rank than the banker's high hand and lower poker rank than the banker's low hand, and the banker pays to the player an amount determined by the player's first, second and third bets if the player's hand is of both higher poker rank than the banker's high hand and lower poker rank than the banker's low hand.

30. A method of playing a poker game by at least one player and a dealer, comprising the steps of:

(a) providing the dealer with a deck of cards for playing poker;

(b) each player placing a first bet before dealing by the dealer of the cards;

(c) the dealer dealing five cards from the deck to each player and to the dealer, at least one of the cards dealt to the dealer positioned face up and the others of the cards dealt to the dealer positioned face down;

(d) each player either (1) folding his or her hand, thereby withdrawing from the game and losing his or her first bet to the dealer, or (2) declaring his or her poker hand as either high or low and placing a second bet, thereby remaining in the game;

(e) each player, if he or she elects, discarding up to a predetermined number of cards from his or her hand;

(f) the dealer drawing cards of said predetermined number from said deck and positioning the drawn cards face up;

(g) each remaining player selecting from said drawn cards the number of cards discarded by the player during step (e) for completing his or her poker hand;

(h) each player, if he or she elects, changing the declaration of his or her poker hand to high-low and placing a third bet;

(i) the dealer selecting five cards from the cards dealt to the dealer and said drawn cards for completing a high poker hand;

(j) the dealer selecting five cards from the cards dealt to the dealer and said drawn cards for completing a low poker hand; and (k) the dealer comparing each remaining player's declared hand to the dealer's hands according to the player's declaration and settling each remaining player's bets according to predetermined criteria for determining winning and losing poker hands and the amounts won.

31. The method according to claim 30, wherein:

in step (c), the cards dealt to each player are dealt face down.

32. The method according to claim 31, wherein:

in step (c), two of the cards dealt to the dealer are positioned face up and three of the cards dealt to the dealer are positioned face down.

33. The method according to claim 31, wherein:

in step (e), each remaining player may discard either one or two cards of his or her selection;

in step (f), said drawn cards are two in number;

in step (g), each remaining player who discarded only one card during step (e) selects one of said drawn cards for completing his or her poker hand, and each remaining player who discarded two cards during step (e) selects both of said drawn cards for completing his or her poker hand.

34. The method according to claim 31, wherein:

in step (b), the amount of each player's first bet is selected by the player from a predetermined minimum up to a predetermined maximum;

in step (d), the amount of each remaining player's second bet is a predetermined multiple of the amount of the player's first bet; and in step (h), the amount of the third bet of each player who changes his or her declaration to high-low is a predetermined multiple of the amount of the player's first bet.

35. The method according to claim 34, wherein:

in step (h), the amount of the third bet of each player who changes his or her declaration to high-low is equal to the amount of the player's second bet.

36. The method according to claim 31, wherein:

during step (b), each player at his or her option may buy into a jackpot with a jackpot buy-in payment; and each player who bought into said jackpot holding a poker hand of a predetermined high ranking combination of cards is a winner of a portion of said jackpot, and each player who bought into said jackpot holding a poker hand of a predetermined low ranking combination of cards is a winner of a portion of said jackpot.

37. The method according to claim 31, wherein step (k) includes the steps of:

the dealer comparing the hand of each player holding a high declared hand to the dealer's high hand, determining winning and losing hands as between the hands compared, and settling the bets of each such player according to whether he or she holds a winning or losing high declared hand;

the dealer comparing the hand of each player holding a low declared hand to the dealer's low hand, determining winning and losing hands as between the hands compared, and settling the bets of each such player according to whether he or she holds a winning or losing low declared hand; and the dealer comparing the hand of each player holding a high-low declared hand to the dealer's hands, determining winning and losing hands as between the hands compared, and settling the bets of each such player according to whether he or she holds a winning or losing high-low declared hand.

38. The method according to claim 37, further including the step of:

the dealer paying a bonus payment to each remaining player holding a losing hand of a predetermined combination of cards.

39. The method according to claim 37, further including the steps of:

the dealer paying a bonus payment to each remaining player holding a poker hand of a predetermined combination of cards losing to the dealer's high hand; and the dealer paying a bonus payment to each remaining player holding a poker hand of a predetermined combination of cards losing to the dealer's low hand.

40. The method according to claim 37, further including the steps of:

the dealer paying a bonus payment to each remaining player holding a poker hand of a predetermined combination of cards losing to the dealer's high hand containing another predetermined combination of cards; and the dealer paying a bonus payment to each remaining player holding a poker hand of a predetermined combination of cards losing to the dealer's low hand containing another predetermined combination of cards.

41. The method according to claim 37, further including the step of:

paying a bonus payment to each remaining player holding a poker hand of a predetermined combination of cards tying one of the dealer's hands.

42. The method according to claim 31, wherein step (k) includes the steps of:

the dealer collecting the bets of each player holding a high declared hand of lower poker rank than the dealer's high hand, and paying to each player holding a high declared hand of higher poker rank than the dealer's high hand an amount determined by the player's bets;

the dealer collecting the bets of each player holding a low declared hand of higher poker rank than the dealer's low hand, and paying to each player holding a low declared hand of lower poker rank than the dealer's low hand an amount determined by the player's bets; and the dealer collecting the bets of each player holding a high-low declared hand which is not of both higher poker rank than the dealer's high hand and lower poker rank than the dealer's low hand, and paying to each player holding a high-low declared hand of both higher poker rank than the dealer's high hand and lower poker rank than the dealer's low hand an amount determined by the player's bets.

43. The method according to claim 31, wherein step (k) includes the steps of:

with respect to a player holding a high declared hand (x) if the player's hand is not of at least a predetermined poker rank, the dealer collects the player's second bet and, if the dealer's high hand is of at least said predetermined rank, the dealer further collects the player's first bet, (y) if the player's hand is of at least said predetermined rank and the dealer's high hand is not of said predetermined rank, the dealer pays to the player an amount determined by the player's second bet, and (z) if the player's hand and the dealer's high hand are each of at least said predetermined rank, the dealer collects the player's first and second bets if the player's hand is of lower poker rank than the dealer's high hand, and the dealer pays to the player an amount determined by the player's first and second bets if the player's hand is of higher poker rank than the dealer's high hand;

with respect to a player holding a low declared hand, the dealer collects the player's first and second bets if the player's hand is of higher poker rank than the dealer's low hand, and the dealer pays to the player an amount determined by the player's first and second bets if the player's hand is of lower poker rank than the dealer's low hand; and with respect to a player holding a high-low declared hand (x) if the player's hand is not of at least said predetermined rank, the dealer collects the player's first, second and third bets, (y) if the player's hand is of at least said predetermined rank and the dealer's high hand is not of at least said predetermined rank, the dealer collects the player's first, second and third bets if the player's hand is not of lower poker rank than the dealer's low hand, and the dealer pays to the player an amount determined by the player's first, second and third bets if the player's hand is of lower poker rank than the dealer's low hand, and (z) if the player's hand and the dealer's high hand are each of at least said predetermined rank, the dealer collects the player's first, second and third bets if the player's hand is not of both higher poker rank than the dealer's high hand and lower poker rank than the dealer's low hand, and the dealer pays to the player an amount determined by the player's first, second and third bets if the player's hand is of both higher poker rank than the dealer's high hand and lower poker rank than the dealer's low hand.

44. The method according to claim 31, wherein step (k) includes the steps of:

with respect to a player holding a high declared hand, the dealer collects the player's first and second bets if the player's hand is of lower poker rank than the dealer's high hand, and the dealer pays to the player an amount determined by the player's first and second bets if the player's hand is of higher poker rank than the dealer's high hand;

with respect to a player holding a low declared hand (x) if the player's hand is not of or lower than a predetermined poker rank, the dealer collects the player's second bet and, if the dealer's low hand is of or lower than said predetermined rank, the dealer further collects the player's first bet, (y) if the player's hand is of or lower than said predetermined rank and the dealer's low hand is not of or lower than said predetermined rank, the dealer pays to the player an amount determined by the player's second bet, and (z) if the player's hand and the dealer's low hand are each of or lower than said predetermined rank, the dealer collects the player's first and second bets if the player's hand is of higher poker rank than the dealer's low hand, and the dealer pays to the player an amount determined by the player's first and second bets if the player's hand is of lower poker rank than the dealer's low hand; and with respect to a player holding a high-low declared hand (x) if the player's hand is not of or lower than said predetermined rank, the dealer collects the player's first, second and third bets, (y) if the player's hand is of or lower than said predetermined rank and the dealer's low hand is not of or lower than said predetermined rank, the dealer collects the player's first, second and third bets if the player's hand is not of higher poker rank than the dealer's high hand, and the dealer pays to the player an amount determined by the player's first, second and third bets if the player's hand is of higher poker rank than the dealer's high hand, and (z) if the player's hand and the dealer's low hand are each of or lower than said predetermined rank, the dealer collects the player's first, second and third bets if the player's hand is not of both higher poker rank than the dealer's high hand and lower poker rank than the dealer's low hand, and the dealer pays to the player an amount determined by the player's first, second and third bets if the player's hand is of both higher poker rank than the dealer's high hand and lower poker rank than the dealer's low hand.

45. The method according to claim 31, wherein a hand considered high qualifies if it is of at least a first predetermined rank and a hand considered low qualifies if it is of or lower than a second predetermined rank, and wherein step (h) includes the steps of:

with respect to a player holding a high declared hand (x) if the player's hand does not qualify, the dealer collects the player's second bet and, if the dealer's high hand qualifies, the dealer further collects the player's first bet, (y) if the player's hand qualifies and the dealer's high hand does not qualify, the dealer pays to the player an amount determined by the player's second bet, and (z) if the player's hand and the dealer's high hand each qualify, the dealer collects the player's first and second bets if the player's hand is of lower poker rank than the dealer's high hand, and the dealer pays to the player an amount determined by the player's first and second bets if the player's hand is of higher poker rank than the dealer's high hand;

with respect to a player holding a low declared hand (x) if the player's hand does not qualify, the dealer collects the player's second bet and, if the dealer's low hand qualifies, the dealer further collects the player's first bet, (y) if the player's hand qualifies and the dealer's low hand does not qualify, the dealer pays to the player an amount determined by the player's second bet, and (z) if the player's hand and the dealer's low hand each qualify, the dealer collects the player's first and second bets if the player's hand is of higher poker rank than the dealer's low hand, and the dealer pays to the player an amount determined by the player's first and second bets if the player's hand is of lower poker rank than the dealer's low hand; and with respect to a player holding a high-low declared hand (x) if the player's hand does not qualify either high or low, the dealer collects the player's first, second and third bets, (y) if the player's hand qualifies both high and low and neither of the dealer's hands qualify, the dealer pays to the player an amount determined by the player's first, second and third bets, (z) if the player's hand qualifies both high and low and the dealer's high hand qualifies and the dealer's low hand does not qualify, the dealer collects the player's first, second and third bets if the player's hand is not of higher poker rank than the dealer's high hand, and the dealer pays to the player an amount determined by the player's first, second and third bets if the player's hand is of higher poker rank than the dealer's high hand, and (xx) if the player's hand qualifies both high and low and the dealer's low hand qualifies and the dealer's high hand does not qualify, the dealer collects the player's first, second and third bets if the player's hand is not of lower poker rank than the dealer's low hand, and the dealer pays to the player an amount determined by the player's first, second and third bets if the player's hand is of lower poker rank than the dealer's low hand, and (xy) if the player's hand qualifies both high and low and the dealer's high and low hands both qualify, the dealer collects the player's first, second and third bets if the player's hand is not of both higher poker rank than the dealer's high hand and lower poker rank than the dealer's low hand, and the dealer pays to the player an amount determined by the player's first, second and third bets if the player's hand is of both higher poker rank than the dealer's high hand and lower poker rank than the dealer's low hand.

* * * * *